US005617610A

United States Patent [19]

Dearaujo

[11] Patent Number: 5,617,610

[45] Date of Patent: Apr. 8, 1997

[54] SELF-CONTAINED SWEEPER AND VACUUM PICK-UP

[76] Inventor: Paul A. Dearaujo, 14767 - 69th St. N., Lox, Fla. 33470

[21] Appl. No.: 652,945

[22] Filed: May 24, 1996

[51] Int. Cl.[6] ..... A47L 5/24

[52] U.S. Cl. ..... 15/328; 15/344; 15/350; 15/354; 15/398

[58] Field of Search ..... 150/350, 352, 150/344, 398, 354, 328

[56] References Cited

U.S. PATENT DOCUMENTS

| | | | |
|---|---|---|---|
| D. 307,657 | 5/1990 | Li | 15/350 X |
| 4,351,083 | 9/1982 | Simonsson | 15/373 |
| 4,573,237 | 3/1986 | Kochte et al. | 15/354 X |
| 4,635,315 | 1/1987 | Kozak | 15/350 X |
| 5,432,976 | 7/1995 | Alazet | 15/398 X |
| 5,440,782 | 8/1995 | Yamashita | 15/398 |
| 5,555,599 | 9/1996 | Markley | 15/373 X |

*Primary Examiner*—Chris K. Moore
*Attorney, Agent, or Firm*—Alvin S. Blum

[57] ABSTRACT

A combined self-contained implement features a broom or brush assembly for sweeping large areas of debris into small piles with a rechargeable battery operated vacuum assembly for aspirating the dirt piles into a bag. The broom and vacuum assembly are slidably mounted relative to one another so that either the bristles or the vacuum extends below the other for unimpeded sweeping or vacuuming. The large areas are swept without battery power. A small, light vacuum pick-up will serve a large area because it is only used for efficiently picking up the small area dirt piles.

4 Claims, 1 Drawing Sheet

FIG. 1
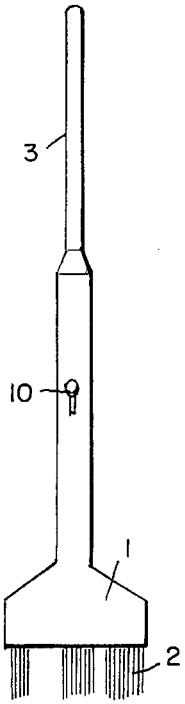
FIG. 2
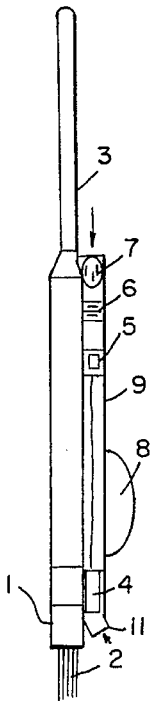
FIG. 3
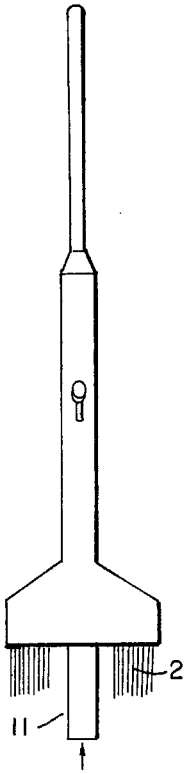
FIG. 4
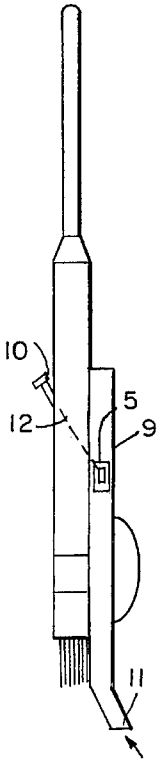
FIG. 5
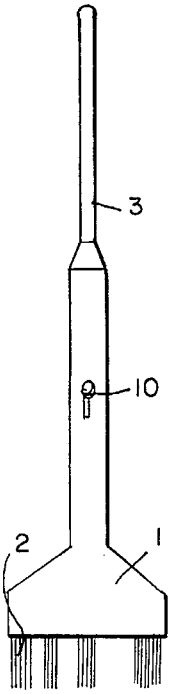
FIG. 6
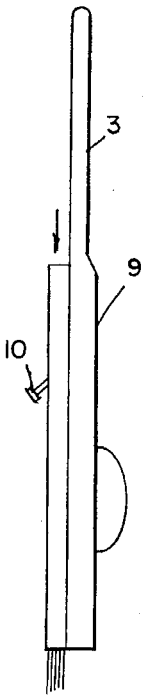
FIG. 7
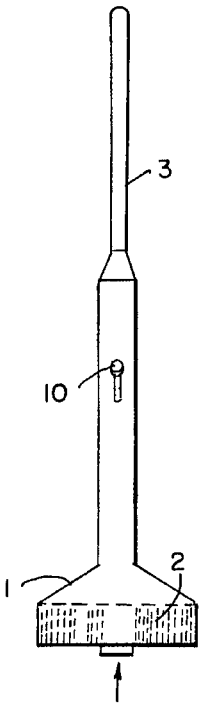
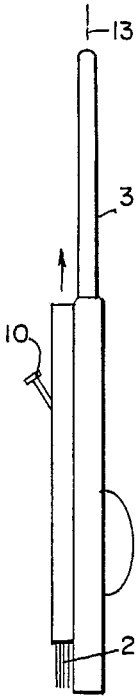
FIG. 8
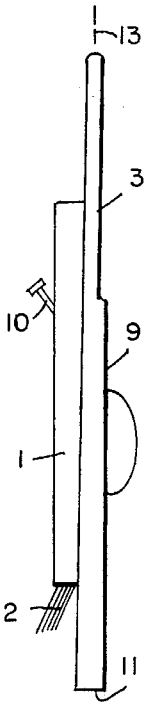
FIG. 9
FIG. 10
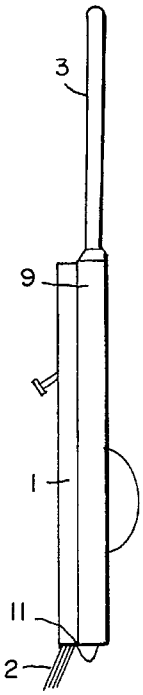

SELF-CONTAINED SWEEPER AND VACUUM PICK-UP

FIELD OF THE INVENTION

The present invention relates to cleaning implements and, more particularly, to a broom for sweeping debris into a pile in combination with a small self-contained electric vacuum device to pick up the pile.

BACKGROUND OF THE INVENTION

General sweeping practice is to sweep up dirt with a brush or broom into a concentrated pile and then sweep the accumulated dirt into a dustpan. The dustpan is then emptied into a waste container. Carrying the dustpan and container about with the broom is awkward. It is easy to spill the dirt when transferring from dustpan to container and to leave some dirt behind when sweeping into the dustpan. Another choice is to use an electric vacuum cleaner to sweep the dirt directly into a closed container while completely traversing the floor area. This requires considerable electric power. A long extension cord to an electric outlet is required. This is awkward in many cleaning situations. Although self-contained battery powered electric vacuum cleaners are well known, they can only be used for small area cleaning because they have too little stored power to clean any significant area.

U.S. Pat. No. 5,437,078 issued Aug. 11, 1995 to Courcelles discloses a dustpan that is removably attachable to a broom. The dustpan can be removed from the broom and used to receive the dirt. A hollow tubular handle on the dustpan is attachable to the tube of an external vacuum source such as a central vacuum system. U.S. Pat. No. 2,631,326 issued Mar. 17, 1953 to Smith discloses a mop and squeegee with a suction tube attachable to an external vacuum source.

None of the prior art apparatus provides a simple, self contained means for picking up the pile of swept up dirt that is easy to use.

SUMMARY OF THE INVENTION

It is, accordingly, an object of the invention to provide a single, self-contained implement that is easy to carry about and use for sweeping up dirt and debris from a large floor area and that also transfers the swept up dirt into an enclosed container that is a part of the implement.

The implement of the invention comprises a broom or brush having a long handle adapted for sweeping debris from a large floor area in combination with a self-powered small electric vacuum cleaner adapted for lifting swept up floor debris from a pile and transfering it into a chamber. The implement of the invention has two modes of operation. In a first mode of operation, the bristles of the broom or brush extend downward below the long handle in a position such that the floor may be swept without interference from the vacuum nozzle. In a second mode of operation, the nozzle of the vacuum extends beyond the bristles so that it contacts the floor or debris pile before the bristles to thereby aspirate the debris unimpeded by the bristles. Because the debris is concentrated in a small area pile at the time of aspiration, the vacuum motor need operate for only a brief period of time. Consequently, a small capacity electric power battery will be practicable even though a large area is being swept.

These and other objects, features and advantages of the invention will become more apparent when the detailed description is studied in conjunction with the drawings in which like reference characters indicate like elements in the various figures.

BRIEF DESCRIPTION OF THE DRAWINGS

FIG. 1 is a front elevation view of a broom of the invention with vacuum apparatus retracted.

FIG. 2 is a side elevation view of the broom of FIG. 1.

FIG. 3 is a front elevation view of the broom of FIG. 1 with vacuum apparatus extended.

FIG. 4 is a side elevation view of the broom of FIG. 3.

FIG. 5 is a front elevation view of another embodiment of the invention with bristles extended.

FIG. 6 is a side elevation view of the sweeper of FIG. 5.

FIG. 7 is a front elevation view of the sweeper of FIG. 5 with bristles retracted.

FIG. 8 is a side elevation view of the sweeper of FIG. 5.

FIG. 9 is a side elevation view of a push broom of the invention with bristles retracted.

FIG. 10 is a side elevation view of the push broom of FIG. 9 bristles extended.

DETAILED DESCRIPTION OF PREFERRED EMBODIMENTS

Referring now first to FIGS. 1–4, the combined sweeping and self-contained vacuum pick-up of the invention comprises a broom 1 with long stiff bristles 2 and a long handle of the type well known in the art for sweeping up debris. Slidably attached to the broom is a self-contained battery operated vacuum pick-up device 9 of the type well known in the art including, as diagrammatically illustrated in FIG. 2, a vacuum fan and motor 4, a switch 5, connecting the motor to a rechargeable battery 6, and a dirt catching bag 8, the details of which are well known. A built in recharger 7 may be provided for connecting to house current. The vacuum pick-up device 9 is adapted for slidably moving between two operating positions under control of control lever 10. In the first operating mode or position, as shown in FIGS. 1 and 2, the pick-up device is retracted so that the bristles 2 extend beyond the vacuum nozzle 11. In this position, the device performs as an ordinary sweeper or broom for sweeping up debris from a large area without any use of the small battery.

In the second position or operating mode as shown in FIGS. 3 and 4, control lever 10 has moved the vacuum pick-up device 9 downward so that nozzle 11 extends down below the ends of the bristles. The vacuum apparatus is switched on and the pile of swept up dirt is aspirated into the bag 8 in a very short time. This puts a very modest load on the battery, so that many large areas may be swept up and then the dirt vacuumed from the piles with a small and light weight combined implement. A linkage 12, shown diagrammatically in phantom in FIG. 4, may be provided to automatically switch on switch 5 when the nozzle is extended.

Referring now to FIGS. 5–8, another embodiment of the invention is shown in which the handle 3 is rigidly attached to the vacuum device or assembly 9 and the broom assembly i is slidably mounted beside the vacuum device 9 to slide up and down in a direction parallel to the long axis 13 of handle 3.

Referring now to FIGS. 9 and 10, another embodiment of the invention is shown in which the broom I has bristles 2 extending at a sloping angle from the long axis 13 of the handle. This is the configuration generally referred to as a push broom or brush used for sweeping large areas.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A combination self-contained sweeper and vacuum pick-up implement comprising:

a brush or broom assembly having a proximal end and a distal end with bristles extending from the distal end;

a self-contained, battery-operated vacuum assembly having a proximal end and a distal end, with a nozzle extending from the distal end;

an elongate handle rigidly attached to one of the broom assembly or the vacuum assembly at the proximal end thereof;

the other of the broom assembly or the vacuum assembly being slidably mounted to the one of the broom assembly or the vacuum assembly; and control means for slidably positioning the bristles below the nozzle in a first mode of operation and for positioning the nozzle below the bristles in a second mode of operation.

2. The implement according to claim 1, further comprising linkage means for automatically activating the vacuum assembly when the nozzle is below the bristles in the second mode of operation.

3. The implement according to claim 1, in which the handle is rigidly attached to the broom assembly.

4. The implement according to claim 1, in which the handle is rigidly attached to the vacuum assembly.

* * * * *